US005441861A

United States Patent [19]

Weber et al.

[11] Patent Number: 5,441,861

[45] Date of Patent: Aug. 15, 1995

[54] COLOR PHOTOGRAPHIC SILVER HALIDE MATERIAL

[75] Inventors: Beate Weber, Leichlingen; Günter Helling, Odenthal; Klaus Walz, Leverkusen; Markus Geiger, Langenfeld; Kaspar Wingender, Leverkusen; Jörg Hagemann, Cologne, all of Germany

[73] Assignee: Agfa-Gevaert AB, Leverkusen, Germany

[21] Appl. No.: 112,192

[22] Filed: Aug. 26, 1993

[30] Foreign Application Priority Data

Sep. 8, 1992 [DE] Germany ..... 42 29 928.4
Mar. 10, 1993 [DE] Germany ..... 43 07 439.1

[51] Int. Cl.[6] ..... G03C 1/08; G03C 7/26; G03C 7/32

[52] U.S. Cl. ..... 430/551; 430/372; 430/543; 430/546; 430/557; 430/602; 430/637

[58] Field of Search ..... 430/551, 372, 546, 543, 430/557, 602, 637

[56] References Cited

U.S. PATENT DOCUMENTS

| | | | |
|---|---|---|---|
| 4,615,970 | 10/1986 | Kojima et al. | 430/602 |
| 4,624,913 | 11/1986 | Miyasaka et al. | 430/602 |
| 4,782,011 | 11/1988 | Goddard et al. | 430/551 |
| 4,894,323 | 1/1990 | Kawai et al. | 430/569 |
| 5,043,255 | 8/1991 | Junkers et al. | 430/546 |
| 5,143,823 | 9/1992 | Kunitz | 430/557 |
| 5,294,530 | 3/1994 | Seto et al. | 430/551 |

FOREIGN PATENT DOCUMENTS

| | | |
|---|---|---|
| 0246766 | 11/1987 | European Pat. Off. . |
| 1137258 | 5/1989 | Japan . |
| 1144048 | 6/1989 | Japan . |
| 1267287 | 3/1972 | United Kingdom . |

*Primary Examiner*—Charles L. Bowers, Jr.
*Assistant Examiner*—Geraldine Letscher
*Attorney, Agent, or Firm*—Connolly & Hutz

[57] ABSTRACT

A color photographic material with at least one silver halide emulsion layer which contains a color coupler distributed in a polymeric oil former and at least one compound of the formula (I)

(I)

in which

R means alkyl, cycloalkyl, alkenyl, aryl, acyl, alkylsulphonyl or arylsulphonyl, $R_1$ means a chemical bond or a divalent bridging member, $R_2$ and $R_3$ mean alkyl, alkoxy, alkenyl, cycloalkyl, aryl or aryloxy or two residues $R_2$ or $R_3$ the remaining atoms of a benzene ring condensed with the phenyl residue and m and n mean 0 to 3, wherein all alkyl, alkoxy, cycloalkyl, alkenyl, aryl, aryloxy and acyl residues may be further substituted, is characterized by improved color stability.

14 Claims, No Drawings

COLOR PHOTOGRAPHIC SILVER HALIDE MATERIAL

The invention relates to a colour photographic silver halide material which has on a support at least one yellow coupling silver halide emulsion layer and is distinguished by improved light stability of the azomethine yellow dye produced by processing.

It is known to produce colour photographic images by chromogenic development, i.e. by developing silver halide emulsion layers exposed over the image area in the presence of suitable colour couplers by means of suitable colour-forming developer substances—so-called colour developers—, wherein the oxidation product of the developer substances, which is produced in congruence with the silver image, reacts with the colour coupler so forming a colour image. Aromatic compounds containing primary amino groups, particularly those of the p-phenylenediamine type, are normally used as colour developers.

It is also known that the image dyes produced by chromogenic development to a varying extent suffer certain changes due to the effects of environmental conditions. The effects of light are particularly influential. It is known that the yellow azomethine dyes produced from open-chain ketomethylene compounds are particularly strongly bleached by light, whereas the cyan dyes produced from phenolic or naphtholic couplers have proved relatively stable and the magenta dyes produced from pyrazolone couplers have now approached the cyan couplers in terms of light stability by the addition of suitable stabilisers.

The object of the invention was therefore to improve the light stability of the yellow dyes such that exposing colour photographs with initially balanced colours to light for moderately long periods does not cause uneven bleaching of the dyes, which would result in a colour cast. The agents proposed to improve the light resistance of magenta dyes are suitable only to a limited extent for stabilising yellow dyes and are moreover associated with many other disadvantages which make them appear poorly suited to practical use. As hydroquinones or hydroquinone derivatives, they are readily oxidisable and frequently give rise to an undesired coloration (yellowing) of the image whites. When stored for moderately long periods they are frequently oxidised by atmospheric oxygen or other oxidants and so become ineffective.

Bisphenol compounds are known from GB 1 267 287 in which both phenolic OH groups are unsubstituted. These compounds are suitable as light stabilisers for yellow dyes, but they are not sufficiently effective.

Bisphenol compounds are known from EP 246 766 in which one phenolic hydroxyl group is substituted. In terms of their light stabilisation these compounds are no better than the free bisphenols of GB 1 267 287, but they do give slightly purer colour hues.

It has now surprisingly been found that bisphenol derivatives with a substituted phenolic OH group together with polymeric oil formers considerably improve the light stability of yellow azomethine dyes without degrading colour purity or colouring image whites.

Polymeric oil formers are compounds soluble in organic solvents having a unit which repeats at least twice in the molecule, with a boiling point in excess of 200° C., in which colour couplers may be dissolved or dispersed.

which repeats at least twice in the molecule, with a boiling point in excess of 200° C., in which colour couplers may be dissolved or dispersed.

The present invention provides a colour photographic material with at least one silver halide emulsion layer which contains at least one colour coupler distributed in a polymeric oil former and at least one compound of the formula (I)

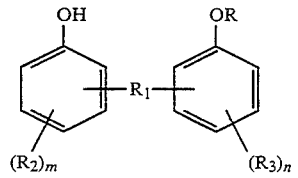

(I)

in which

R means alkyl, cycloalkyl, alkenyl, aryl, acyl, alkylsulphonyl or arylsulphonyl, $R_1$ means a chemical bond or a divalent bridging member, $R_2$ and $R_3$ means alkyl, alkoxy, alkenyl, cycloalkyl, aryl or aryloxy or two residues $R_2$ or $R_3$ the remaining atoms of a benzene ring condensed with a phenyl residue and m and n mean 0 to 3, wherein all alkyl, alkoxy, cycloalkyl, alkenyl, aryl, aryloxy and acyl residues may be further substituted.

Suitable bridging members $R_1$ are, for example, alkene, alkylidene or sulphonyl groups together with heteroatoms such as O and S. Examples of R are methyl, ethyl, propyl, butyl, cyclohexyl, phenyl, acetyl and benzyl.

Preferred compounds of the formula (I) are those of the general formula (II)

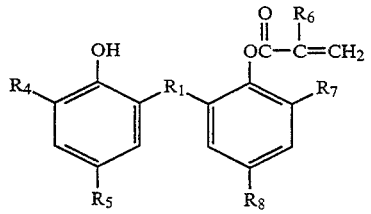

(II)

in which $R_4$, $R_5$, $R_7$ and $R_8$ mean alkyl or aryl and $R_6$ means hydrogen or alkyl, wherein the alkyl and aryl residues may be substituted.

The present invention further provides a colour photographic material which in at least one layer contains a compound of formula (IV)

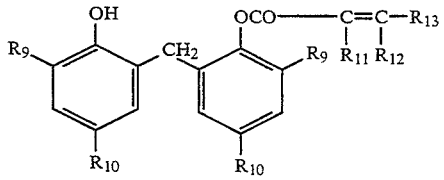

(IV)

in which $R_9$ which are the same or different denotes

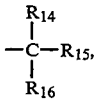

$R_{10}$ which are the same or different denotes alkyl, particularly with 1 to 9 C-atoms, $R_{11}$ means H or alkyl, $R_{12}$ means H, aryl or alkyl, $R_{13}$ means H, aryl or alkyl, $R_{14}$ and $R_5$ are the same or different and mean alkyl, particularly with 1 to 4 C-atoms, $R_{16}$ means H or alkyl, particularly with 1 to 4 C-atoms.

With these compounds and without polymeric oil-formers an improvement in stability of the yellow coupler is already obtained.

Preferably, both radicals $R_9$ have the same meaning and both radicals $R_{10}$ have the same meaning. $R_9$ is preferably isopropyl, tertiary butyl, cyclohexyl, tertiary pentyl and 1-methylcyclohexyl. $R_{10}$ is preferably methyl, ethyl, propyl, isopropyl, n-butyl, isobutyl, secondary butyl, tertiary butyl, n-pentyl, tertiary pentyl or nonyl.

$R_{11}$, $R_{12}$, $R_{13}$ are particularly H or methyl.

The following compounds are suitable examples

I-1

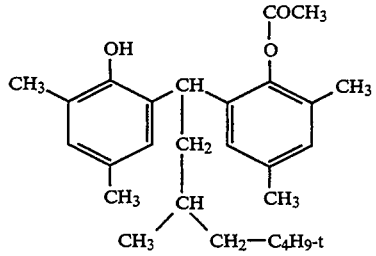

I-2

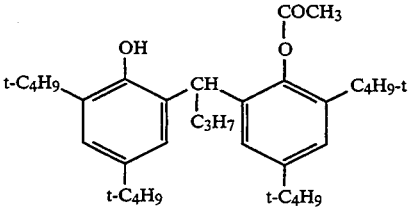

I-3

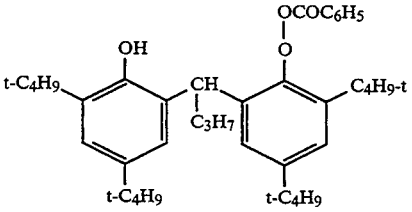

I-4

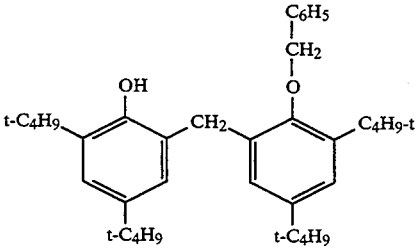

-continued

I-5

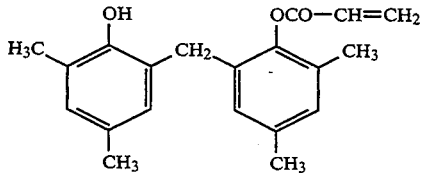

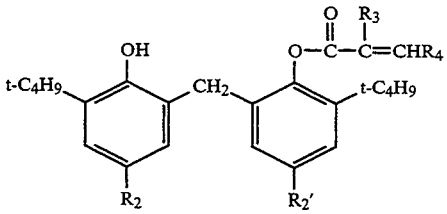

| Compound | $R_2$ | $R_{2'}$ | $R_3$ | $R_4$ |
|---|---|---|---|---|
| I-6 | $C_2H_5$ | $C_2H_5$ | H | H |
| I-7 | t-$C_4H_9$ | t-$C_4H_5$ | H | H |
| I-8 | n-$C_4H_9$ | n-$C_4H_9$ | H | H |
| I-9 | $CH_3$ | $CH_3$ | H | H |
| I-10 | $C_9H_{19}$ | $C_9H_{19}$ | H | H |
| I-11 | $C_2H_5$ | $C_2H_5$ | $CH_3$ | H |
| I-12 | $CH_3$ | $CH_3$ | $CH_3$ | H |
| I-13 | $CH_3$ | $CH_3$ | H | $CH_3$ |
| I-14 | $CH_3$ | $CH_3$ | H | $C_6H_5$ |
| I-15 | t-$C_4H_9$ | t-$C_4H_9$ | $CH_3$ | H |

also

I-16

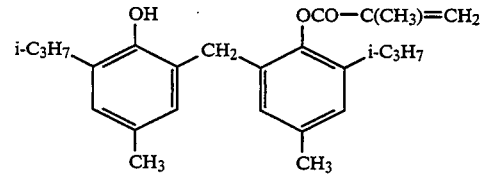

I-17

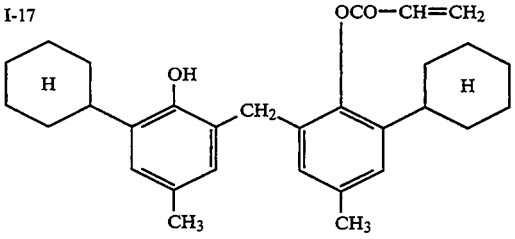

I-18

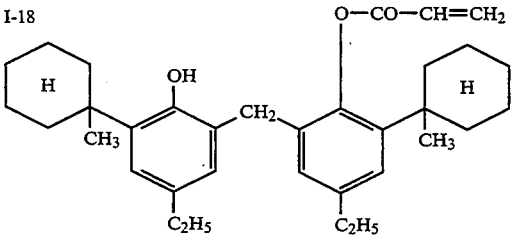

I-19

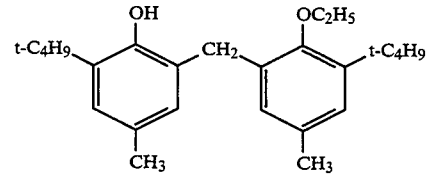

-continued

I-20 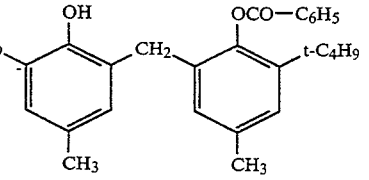

Compounds of the formulae (I), (II) and (IV) which contain polymerisable double bonds, for example I-5 to I-18, may also be present in oligomeric or polymeric form.

The bisphenol compounds are preferably used in an amount of 0.1 to 2 g/g of colour coupler, in particular in an amount of 0.1 to 1 g/g of colour coupler.

The average molecular weight of the polymeric oil formers (weight average) is preferably no greater than 200 000, preferably 400 to 100 000. The polymeric oil formers are preferably 400 to 100 000. The polymeric oil formers are preferably used in an amount of 0.05 to 10 g/g of colour coupler, in particular in an amount of 0.1 to 4 g/g of colour coupler.

By way of example, the following are examples of polymeric oil formers according to the present invention:

1. Vinyl polymers and copolymers, acrylates such as methyl acrylate, ethyl acrylate, isopropyl acrylate, butyl acrylate, t-butyl acrylate, amyl acrylate, hexyl acrylate, 2-ethylhexyl acrylate, t-octyl acrylate, cyanoethyl acrylate, 2-acetoxyethyl acrylate, dimethylaminoethyl acrylate, methoxybenzyl acrylate, cyclohexyl acrylate, tetrahydrofurfuryl acrylate, phenyl acrylate, 2,2,-dimethyl-3-hydroxypropyl acrylate, 2-methoxyethyl acrylate, 2-ethoxyethyl acrylate, 2-isopropoxy acrylate, 2-(2-methoxyethoxy)ethyl acrylate; methacrylates such as methyl methacrylate, ethyl methacrylate, propyl methacrylate, butyl methacrylate, isobutyl methacrylate, amyl methacrylate, cyclohexyl methacrylate, benzyl methacrylate, octyl methacrylate, sulphopropyl methacrylate, N-ethyl-N-phenylaminoethyl methacrylate, dimethylaminophenoxyethyl methacrylate, furfuryl methacrylate, glycidyl methacrylate, phenyl methacrylate, cresyl methacrylate, naphthyl methacrylate, 2-hydroxyethyl methacrylate, triethylene glycol methacrylate, 2-methoxyethyl methacrylate, 2-acetoxyethyl methacrylate, 2-ethoxylethyl methacrylate, 2-(2-methoxyethoxy)ethyl methacrylate and $\omega$-methoxypolyethylene glycol methacrylate, vinyl esters such as vinyl acetate, vinyl propionate, vinyl butylate, vinyl isobutylate, vinyl caproate, vinyl chloroacetate, vinyl methoxyacetate, vinyl phenylacetate, vinyl benzoate and vinyl salicylate; acrylamides such as acrylamide, ethyl acrylamide, propyl acrylamide, butyl acrylamide, t-butyl acrylate, cyclohexyl acrylamide, benzyl acrylamide, hydroxymethyl acrylamide, methoxyethyl acrylamide, dimethylaminoethyl acrylamide, phenyl acrylamide, dimethyl acrylamide, $\beta$-cyanoethyl acrylamide, N-(2-acetoxyethyl) acrylamide and diacetone acrylamide; methacrylamides such as methacrylamide, methyl methacrylamide, ethyl methacrylamide, propyl methacrylamide, butyl methacrylamide, t-butyl methacrylamide, cyclohexyl methacrylamide, benzyl methacrylamide, hydroxymethyl methacrylamide, methoxyethyl methacrylamide, dimethylaminoethyl methacrylamide, phenyl methacrylamide, $\beta$-cyanoethyl methacrylamide and N-(2-acetoacetoxyethyl) methacrylamide; olefins such as dicyclopentadiene, ethylene, propylene, 1-butene, 1-pentene, vinyl chloride, vinylidene chloride, isoprene, chloroprene, butadiene and 2,3-dimethyl butadiene; styrenes such as styrene, methyl styrene, trimethyl styrene, ethyl styrene, chloromethyl styrene, methoxy styrene, chlorostyrene, dichlorostyrene and methyl vinyl benzoate; crotonates such as butyl crotonate and hexyl crotonate, itaconates such as dimethyl itaconate and dibutyl itaconate; maleates such as diethyl maleate, dimethyl maleate and dibutyl maleate, fumarates such as diethyl fumarate, dimethyl fumarate and dibutyl fumarate; allyl compounds such as allyl acetate, allyl caproate, allyl laurate and allyl benzoate; vinyl ethers such as methyl vinyl ether, butyl vinyl ether, methoxyethyl vinyl ether and dimethylaminoethyl vinyl ether; vinyl ketones such as methyl vinyl ketone, phenyl vinyl ketone and methoxyethyl vinyl ketone; heterocyclic vinyl compounds such as vinyl pyridine, N-vinyl imidazole, N-vinyl oxazolidone, N-vinyl triazole and N-vinyl pyrrolidone; glycidyl esters such as glycidyl acrylate and glycidyl methacrylate; and unsaturated nitriles such as acrylonitrile and methacrylonitrile. Monomers having urea and/or urethane groups may also be contained. The polymeric oil formers may here be homopolymers of the above-stated monomers or copolymers of two or more of the previously stated monomers. The polymers may contain monomers with acid group in such a quantity that makes them non water- soluble. Examples of monomers with acid groups are acrylic acid, methacrylic acid, itaconic acid, maleic acid, itaconic acid monoalkyl ester, maleic acid monoalkyl ester, citraconic acid, styrene sulphonic acid, vinylbenzyl-sulphonic acid, acryloyloxyalkylsulphonic acid, methacryloyloxyalkylsulphonic acid, acrylamidealkyl-sulphonic acid, methacrylamidealkyl-sulphonic acid, acryloyloxyalkyl phosphate and methacryloylalkyl phosphate. These acids may also be used in the form of a salt with an alkali metal such as sodium and potassium or with an ammonium ion. Acrylates, acrylamides and methacrylates are the preferred monomers for the formation of the polymeric oil formers according to this invention. The polymers may be produced by solution polymerisation, bulkpolymerisation, suspension polymerisation and latex polymerisation.

Free-radical polymerisation of an ethylenically unsaturated monomer is initiated by adding a free radical, which is formed by the thermal decomposition of a chemical initiator, by the action of a reducing agent on an oxidising compound (redox initiator) or by physical action, such as irradiation with ultra-violet rays or other high-energy rays, high frequencies etc.

Examples of chemical initiators includes persulphates (for example ammonium persulphate or potassium persulphate), hydrogen peroxide, organic peroxides (for example benzoyl peroxide or t-butyl peroctoate) and azonitrile compounds (for example 4,4'-azobis-4-cyanovaleric acid or azobis-isobutyronitrile).

Examples of conventional redox initiators include hydrogen peroxide iron(II) salt, potassium persulphate, sodium metabisulphite and cerium(IV) salt alcohol etc.

Examples of the initiators and their functions are described in F. A. Bovey in *Emulsion Polymerisation*, Interscience Publishers Inc., New York, 1955, pages 59 to 93.

A compound with surface-active effect is used as an emulsifier which may be used in emulsion polymerisation. Preferred examples of this include soap, a sulphonate, a sulphate, a cationic compound, an amphoteric compound and a protective colloid with a high molecular weight. Special examples of emulsifiers and their functions are described in *Belgische Chemische Industrie*, vol. 28, pages 16 to 20, 1963.

2. Polyesters produced by polycondensation of polyhydric alcohols and polybasic acids.

Polyhydric alcohols are glycols with a hydrocarbon chain of 2 to 12 carbon atoms, in particular with an aliphatic hydrocarbon chain or polyalkene glycols. Polybasic acids are dicarboxylic acids, the carboxyl groups of which are separated from each other by a hydrocarbon chain with 1 to 12 carbon atoms. Examples of polyhydric alcohols are ethylene glycol, diethylene glycol, 1,2-propylene glycol, 1,3-propylene glycol, trimethylol propane, 1,4-butanediol, isobutylenediol, 1,5-pentanediol, neopentyl glycol, 1,6-hexanediol, 1,8-octanediol, 1,9-nonanediol, 1,10-decanediol, glycerol, diglycerol, triglycerol, 1-methyl glycerol, pentaerythritol, mannitol and sorbitol. Examples of polybasic acids are oxalic acid, succinic acid, glutaric acid, adipic acid, pimelic acid, suberic acid, azelaic acid, sebacic acid, decane dicarboxylic acid, dodecane dicarboxylic acid, fumaric acid, maleic acid, itaconic acid, citraconic acid, phthalic acid, isophthalic acid, terephthalic acid, tetrachlorophthalic acid, metaconic acid, isopimelic acid and the adduct of cyclopentadiene and maleic anhydride.

3. Polyesters produced by ring-opening polycondensation These polyesters are produced from $\beta$-propiolactone, $\alpha$-caprolactone and dimethylpropiolactone.

4. Other polymers

Polycarbonates produced by polycondensation of a glycol or bisphenol with a carbonic acid ester or phosgene, polyurethane resins produced by polyaddition of a polymeric alcohol with a polyisocyanate and polyamide resins produced by polycondensation of a polyvalent amine and a polybasic acid, phenolic aldehyde resins produced by polycondensation of phenols and aldehyde; alkene oxide addition products of phenolic aldehyde resins, polyaddition products of alkene oxides; polyepoxides obtained by reacting bisphenols, alcohols, diamines or compounds containing sulphur (such as dithiophenols), phenolic aldehyde resins, polyalcohols, polycarboxylic acids, polyamines with epihalogenhydrin (for example epichlorohydrin) or from polyisocyanates and glycidol.

Preferred polymeric oil formers correspond to the formula (III)

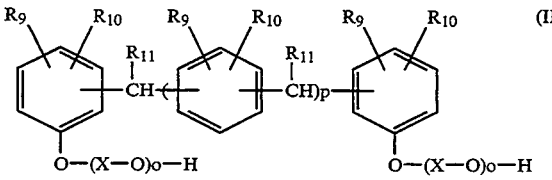

(III)

in which $R_9$ and $R_{10}$ mean alkyl $R_{11}$ means hydrogen or alkyl

X means $—CH_2—CH_2—$ or

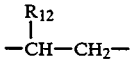

$R_{12}$ means alkyl o means 1 to 10 p means 0 to 20.

$R_9$ preferably stands for hydrogen and $R_{10}$ for a $C_1$–$C_{12}$ alkyl residue, which is in particular in para position to the oxygen.

$R_{11}$ is in particular hydrogen; $R_{12}$ is in particular methyl; o is in particular 1 to 5; p is in particular 0 to 5.

Polymers with the following structural units are examples of preferred polymeric oil formers.

P 1
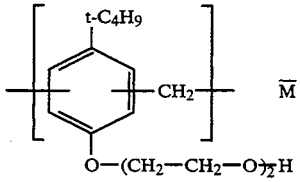

$\overline{M}$ = 600

P 2
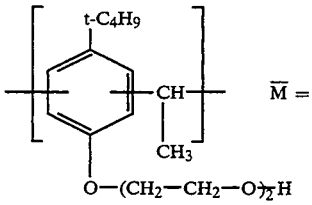

$\overline{M}$ = 1000

P 3
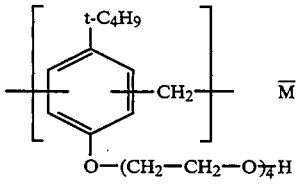

$\overline{M}$ = 700

P 4
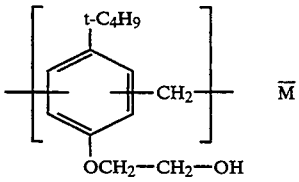

$\overline{M}$ = 500

P 5
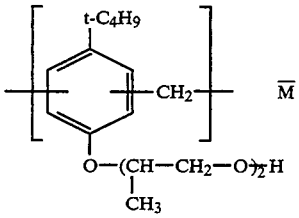

$\overline{M}$ = 600

P 6
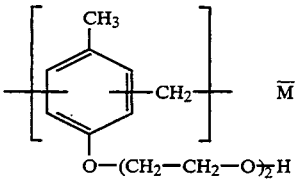

$\overline{M}$ = 500

P 7
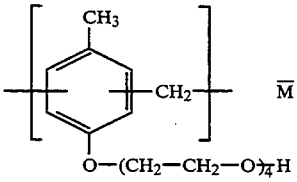

$\overline{M}$ = 600

-continued

P 8

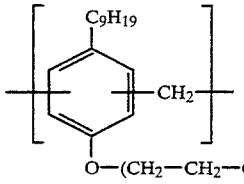

$\overline{M}$ = 700

P 9

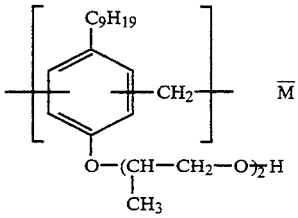

$\overline{M}$ = 700

P 10

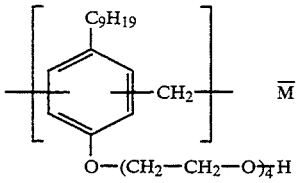

$\overline{M}$ = 1200

P 11

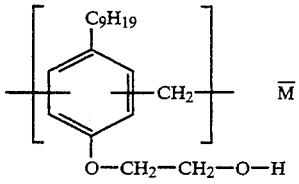

$\overline{M}$ = 600

P 12

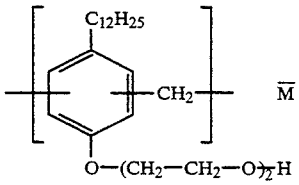

$\overline{M}$ = 700

P 13

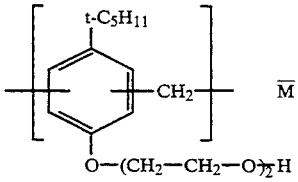

$\overline{M}$ = 700

P 14

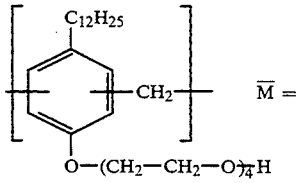

$\overline{M}$ = 800

P 15

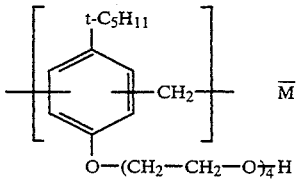

$\overline{M}$ = 800

-continued

P 16

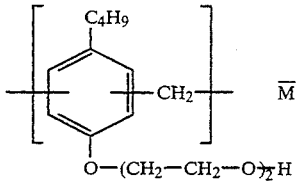

$\overline{M}$ = 800

The preferred polymeric oil formers are produced by addition of alkene oxides to phenolic aldehyde resins.

The compounds according to the invention are preferably used in combination with yellow couplers.

Dye stabilisation of photographic materials is, however, also achieved with other couplers, magenta and cyan couplers.

Examples of colour photographic materials are colour negative films, colour reversal films, colour positive films, colour photographic paper, colour reversal photographic paper, colour sensitive materials for the dye diffusion transfer process or the silver dye bleaching process.

Suitable supports for the production of colour photographic materials are, for example, films and sheets of semi-synthetic and synthetic polymers, such as cellulose nitrate, cellulose acetate, cellulose butyrate, polystyrene, polyvinyl chloride, polyethylene terephthalate and polycarbonate and paper laminated with a barytes layer or an $\alpha$-olefin polymer layer (for example polyethylene). These supports may be coloured with dyes and pigments, for example titanium dioxide. They may also be coloured black in order to provide light shielding. The surface of the support is generally subjected to a treatment in order to improve the adhesion of the photographic emulsion layer, for example to a corona discharge with subsequent application of a substrate layer.

The material is preferably a colour photographic paper with paper laminated on both sides with polyethylene as the support.

The colour photographic materials customarily contain at least one red-sensitive, one green-sensitive and one blue-sensitive silver halide emulsion layer, optionally together with interlayers and protective layers.

The substantial constituents of the colour photographic emulsion layers are binder, silver halide granules and colour couplers.

Gelatine is preferably used as the binder. Gelatine may, however, be entirely or partially replaced with other synthetic, semi-synthetic or also naturally occurring polymers. Synthetic gelatine substitutes are, for example, polyvinyl alcohol, poly-N-vinyl pyrrolidone polyacrylamides, polyacrylic acid and the derivatives thereof, in particular the copolymers thereof. Naturally occurring gelatine substitutes are, for example, other proteins such as albumin or casein, cellulose, sugar, starch or alginates. Semi-synthetic gelatine substitutes are usually modified natural products. Cellulose derivatives such as hydroxyalkyl cellulose, carboxymethyl cellulose and phthalyl cellulose together with gelatine derivatives obtained by reaction with alkylating or acylating agents or by grafting polymerisable monomers, are examples of such products.

The binders should have a sufficient quantity of functional groups available so that satisfactorily resistant layers may be produced by reaction with suitable hardeners. Such functional groups are in particular amino groups, but also carboxyl groups, hydroxyl groups and active methylene groups.

The preferably used gelatine may be obtained by acid or alkaline digestion. Oxidised gelatine may also be used. The production of such gelatines is described, for example, in *The Science and Technology of Gelatine*, edited by A. G. Ward and A. Courts, Academic Press 1977, pages 295 et seq. The gelatine used in each case should have a content of photographically active impurities which is as low as possible (inert gelatine). Gelatines with high viscosity and low swelling are particularly advantageous.

The silver halide present in the photographic material as the light-sensitive constituent may contain chloride, bromide or iodide or mixtures thereof as the halide. For example, the halide content of at least one layer may consist of 0 to 15 mol% iodide, 0 to 100 mol% chloride and 0 to 100 mol% bromide. In the case of colour negative and colour reversal films, silver bromide-iodide emulsions are customarily used, in the case of colour negative and colour reversal paper silver chloride-bromide emulsions with a high chloride content up to pure silver chloride emulsions are customarily used. The crystals may be predominantly compact, for example regularly cubic or octahedral or they may have transitional shapes. Preferably, however, lamellar crystals may also be present, the average ratio of diameter to thickness of which is preferably at least 5:1, wherein the diameter of a grain is defined as the diameter of a circle the contents of which correspond to the projected surface area of the grain. The layers may, however, also have tabular silver halide crystals, in which the ratio of diameter to thickness is substantially greater than 5:1, for example 12:1 to 30:1.

The silver halide grains may also have a multi-layered grain structure, in the simplest case with one internal zone and one external zone of the grain (core/shell), wherein the halide composition and/or other modifications, such as for example doping, of the individual grain zones are different. The average grain size of the emulsions is preferably between 0.2 μm and 2.0 μm, the grain size distribution may be both homodisperse and heterodisperse. A homodisperse grain size distribution means that 95% of the grains do not deviate by more than ±30% from the average grain size. The emulsions may, in addition to the silver halide, also contain organic silver salts, for example silver benzotriazolate or silver behenate.

Two or more types of silver halide emulsions which are produced separately may be used as a mixture.

The photographic emulsions may be produced by various methods (for example P. Glafkides, *Chimie et Physique Photographique*, Paul Montel, Paris (1967), G. F. Duffin, *Photographic Emulsion Chemistry*, The Focal Press, London (1966), V. L. Zelikman et al, *Making and Coating Photographic Emulsion*, The Focal Press, London (1966) from soluble silver salts and soluble halides.

Precipitation of the silver halide preferably proceeds in the presence of the binder, e.g. gelatine, and may be performed in an acid, neutral or alkaline pH range, wherein silver halide complexing agents are preferably additionally used. Such agents include, for example, ammonia, thioether, imidazole, ammonium thiocyanate or excess halide. The water-soluble silver salts and the halides are brought together optionally consecutively using the single jet process or simultaneously using the double jet process or by any combination of both processes. Feeding is preferably performed with rising inflow rates, wherein the 'critical' feed rate, at which no further new nuclei are formed, should not be exceeded. The pAg range may vary within wide limits during precipitation, the so-called pAg-controlled process is preferably used in which a specific pAG value is held constant or a defined pAg profile is followed during precipitation. In addition to the preferred precipitation with a halide excess, so-called inverse precipitation with a silver ion excess is, however, also possible. Apart from by precipitation, the silver halide crystals may also grow by physical ripening (Ostwald ripening) in the presence of excess halide and/or a silver halide complexing agent. Growth of the emulsion grains may even predominantly proceed by Ostwald ripening, wherein preferably a fine grained, so-called Lippmann emulsion is mixed with a more sparingly soluble emulsion and redissolved onto it.

Salts or complexes of metals such as Cd, Zn, Pb, Tl, Bi, Ir, Rh, Fe may also be present during precipitation and/or physical ripening of the silver halide grains.

Precipitation may furthermore also proceed in the presence of sensitising dyes. Complexing agents and/or dyes may be made ineffective at any desired point in time, for example by altering the pH value or by oxidative treatment.

On completion of crystal formation, or also at an earlier point in time, the soluble salts are eliminated from the emulsion, for example by noodling and washing, by flocculation and washing, by ultrafiltration or by ion exchangers.

The silver halide emulsion is generally subjected to chemical sensitisation under defined conditions—pH, pAg, temperature, gelatine concentration, silver halide concentration and sensitiser concentration—until the optimum sensitivity and fog are achieved. The procedure is described in, for example, H. Frieser, *Die Grundlagen der Photographischen Prozesse mit Silberhalogeniden*, pages 675–734, Akademische Verlagsgesellschaft (1968).

At this stage, chemical sensitisation may proceed with the addition of compounds of sulphur, selenium, tellurium and/or compounds of metals of subgroup VIII of the periodic table (e.g. gold, platinum, palladium, iridium), furthermore there may be added thiocyanate compounds, surface-active compounds, such as thioethers, heterocyclic nitrogen compounds (for example imidazoles, azaindenes) or also spectral sensitisers (described, for example, in F. Hamer, *The Cyanine Dyes and Related Compounds*, 1964, or *Ullmanns Encyclopadie der technischen Chemie*, 4th edition, volume 18, pages 431 et seq, and *Research Disclosure* 17643 (December 1978), section III). Alternatively or additionally, reduction sensitisation may be performed by adding reducing agents (tin(II) salts, amines, hydrazine derivatives, aminoboranes, silanes, formamidinesulphinic acid), by hydrogen, by low pAg (for example, less than 5) and/or high pH (for example, greater than 8).

The photographic emulsions may contain compounds to prevent fogging or to stabilise the photographic function during production, storage or photographic processing.

Particularly suitable are azaindenes, preferably tetra and pentaazaindenes, particularly those substituted with hydroxyl or amino groups. Such compounds have been described, for example, by Birr, Z. *Wiss. Phot.*, 47, (1952), pages 2–58. Furthermore, salts of metals such as mercury or cadmium, aromatic sulphonic or sulphinic acids such as benzenesulphinic acid, or heterocyclics containing nitrogen such as nitrobenzimidazole, nitroindazole, optionally substituted benzotriazoles or benzothiazolium salts may also be used as anti-fogging agents. Particularly suitable are heterocyclics containing mercapto groups, for example mercaptobenzothiazoles, mercaptobenzimidazoles, mercaptotetrazoles, mercaptothiadiazoles, mercaptopyrimidines, wherein these mercaptoazoles may also contain a water solubilising group, for example a carboxyl group or sulpho group. Further suitable compounds are published in *Research Disclosure* 17643 (December 1978), section VI.

The stabilisers may be added to the silver halide emulsions before, during or after ripening of the emulsions. Naturally, the compounds may also be added to other photographic layers which are assigned to a silver halide layer.

Mixtures of two or more of the stated compounds may also be used.

The photographic emulsion layers or other hydrophilic colloidal layers of the light-sensitive material produced according to the invention may contain surface-active agents for various purposes, such as coating auxiliaries, to prevent formation of electric charges, to improve sliding properties, to emulsify the dispersion, to prevent adhesion and to improve photographic characteristics (e.g. acceleration of development, greater contrast, sensitisation etc.). Apart from natural surface-active compounds, for example saponin, it is mainly synthetic surface-active compounds (surfactants) which are used: non-ionic surfactants, for example alkene oxide compounds, glycerol compounds or glycidol compounds, cationic surfactants, for example higher alkylamines, quaternary ammonium salts, pyridine compounds and other heterocyclic compounds, sulphonium compounds or phosphonium compounds, anionic surfactants containing an acid group, e.g. carboxylic acid, sulphonic acid, a phosphoric acid, sulphuric acid ester or phosphoric acid ester group, ampholytic surfactants, for example amino acid and aminosulphonic acid compounds together with sulphuric or phosphoric acid esters of an amino alcohol.

The photographic emulsions may be spectrally sensitised by using methine dyes or other dyes. Particularly suitable dyes are cyanine dyes, merocyanine dyes and complex merocyanine dyes.

An overview of the polymethine dyes suitable as spectral sensitisers, the suitable combinations of the dyes and the combinations with supersensitising effects is contained in Research Disclosure 17643 (December 1978), section IV.

In particular, the following dyes—classified by spectral range—are suitable:

1. as red sensitisers 9-ethylcarbocyanines with benzothiazole, benzoselenazole or naphthothiazole as basic terminal groups, which may be substituted in 5th or 6th position by halogen, methyl, methoxy, carbalkoxy, aryl, together with 9-ethyl-naphthoxathia- or -selenocarbocyanines and 9-ethyl-naphthothiaoxa- or -benzoimidazocarbocyanines, provided that the dyes bear at least one sulphoalkyl group on the heterocyclic nitrogen.
2. as green sensitisers 9-ethylcarbocyanines with benzoxazole, naphthoxazole or a benzoxazole and a benzothiazole as basic terminal groups, together with benzimidazolecarbocyanines, which may also be further substituted and must also contain at least one sulphoalkyl group on the heterocyclic nitrogen.
3. as blue sensitisers symmetrical or asymmetrical benzimidiazo-, oxa-, thia- or selenocyanines with at least one sulphoalkyl group on the heterocyclic nitrogen and optionally further substituents on the aromatic ring, together with apomerocyanines with a rhodanine group.

To the differently sensitised emulsion layers are assigned non-diffusing monomeric or polymeric colour couplers which may be located in the same layer or in an adjacent layer. Usually, cyan couplers are assigned to the red-sensitive layers, magenta couplers to the green-sensitive layers and yellow couplers to the blue-sensitive layers.

Colour couplers to produce the cyan partial colour image are generally couplers of the phenol or α-naphthol type.

Colour couplers to produce the magenta partial colour image are generally couplers of the 5-pyrazolone, indazolone or pyrazoloazole type. Colour couplers to produce the yellow partial colour image are generally couplers with an open-chain ketomethylene grouping, in particular couplers of the α-acylacetamide type, for example α-benzoylacetanilide couplers and α-pivaloylacetanilide couplers.

The following are, for example, suitable yellow couplers:

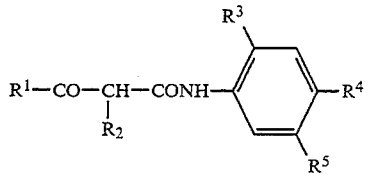

Y-1: $R^1 = -C_4H_9\text{-t}$;

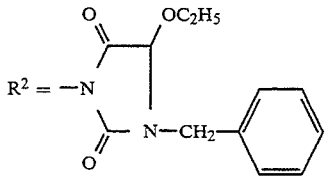

; $R^3 = Cl$; $R^4 = H$;

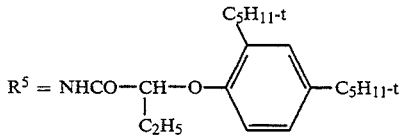

Y-2: $R^1 = -C_4H_9\text{-t}$;

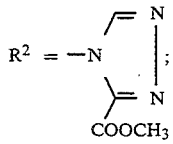

; $R^3 = -OC_{16}H_{33}$; $R^4 = H$;

$R^5 = -SO_2NHCH_3$

Y-3: $R^1 = -C_4H_9\text{-t}$;

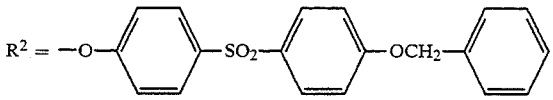

;

-continued $R^3 = Cl$ $R^4 = H$; $R^5 = -NHSO_2-C_{16}H_{33}$

Y-4: $R^1 = -C_4H_9$-t;

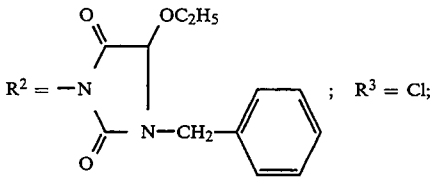

; $R^3 = Cl$;

$R^4 = H$; $R^5 = -COOC_{12}H_{25}$

Y-5: $R^1 = -C_4H_9$-t;

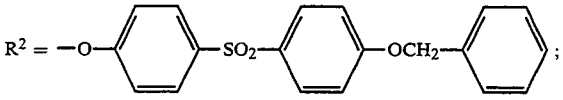

;

$R^3 = Cl$;

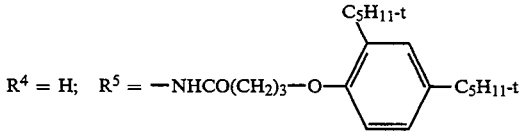

Y-6: $R^1 = -C_4H_9$-t;

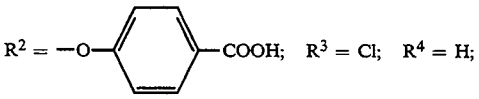

; $R^3 = Cl$; $R^4 = H$;

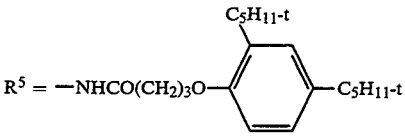

Y-7: $R^1 = -C_5H_9$-t;

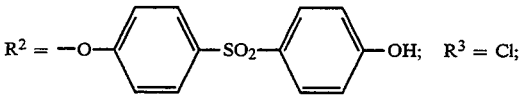

; $R^3 = Cl$;

$R^4 = H$; $R^5 = -NHSO_2-C_{16}H_{33}$

Y-8: $R^1 = -C_4H_9$-t;

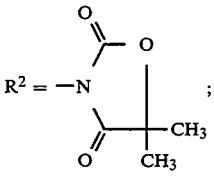

; $R^3 = Cl$; $R^4 = H$;

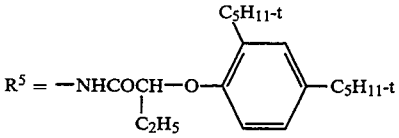

Y-9: $R^1 = -C_4H_9$-t;

-continued

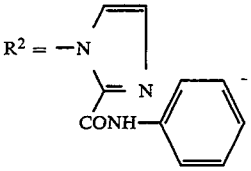

; $R^3 = -OC_{16}H_{33}$;

$R^4 = H$; $R^5 = -SO_2NHCOC_2H_5$

Y-10: $R^1 = -C_4H_9$-t;

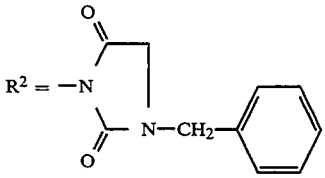

; $R^3 = Cl$; $R^4 = H$

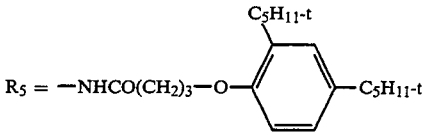

Y-11: $R^1 = -C_4H_9$-t;

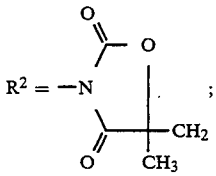

; $R^3 = Cl$; $R^4 = H$;

$R^5 = -COOCH(C_4H_9)-COOC_{12}H_{25}$

Y-12: $R^1 = -C_4H_9$-t;

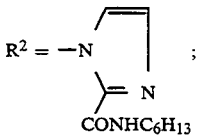

; $R^3 = Cl$; $R^4 = H$;

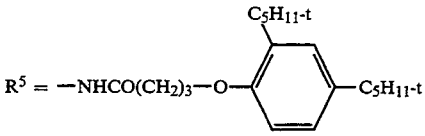

Y-13: $R^1 = -C_4H_9$-t;

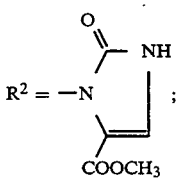

; $R^3 = -OC_{16}H_{33}$; $R^4 = H$;

$R^5 = -SO_2NHCH_3$

Y-14: $R^1 = -C_4H_9$-t;

-continued

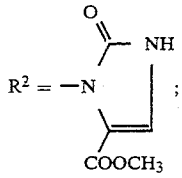

; $R^3$ = Cl; $R^4$ = H;

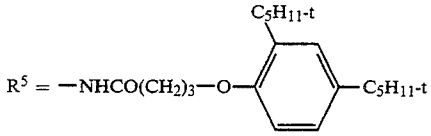

Y-15: $R^1$ = 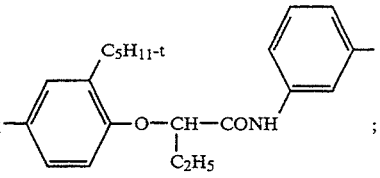

;

$R^2$, $R^4$, $R^5$ = H; $R^3$ = $-OCH_3$

Y-16: $R^1$ = 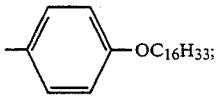

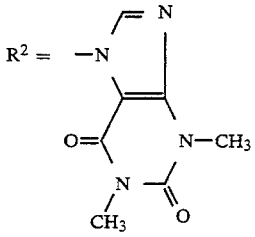

$R^3$, $R^5$ = $-OCH_3$; $R^4$ = H

Y-17: $R^1$ = 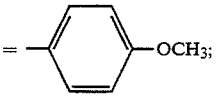

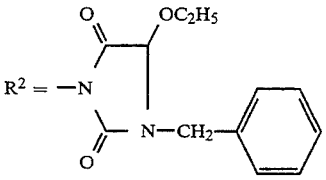

$R^3$ = Cl; $R^4$ = H; $R^5$ = $-COOC_{12}H_{25}$

Y-18: $R^1$ = 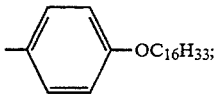

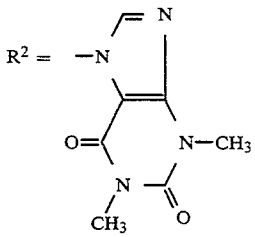

-continued $R^3$ = Cl; $R^4$, $R^5$ = $-OCH_3$

Y-19: $R^1$ = 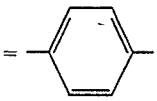

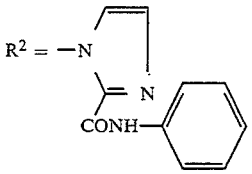

$R^3$ = $-OCH_3$; $R^4$ = H; $R^5$ = $-SO_2N(CH_3)_2$

Y-20: $R^1$ = 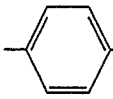

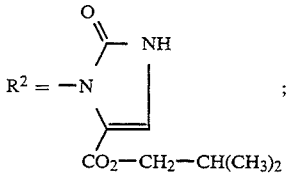

;

$R^3$ = $-OCH_3$; $R^4$ = H;

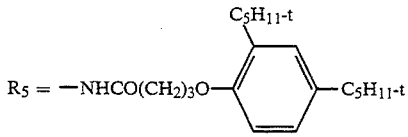

Y-21:

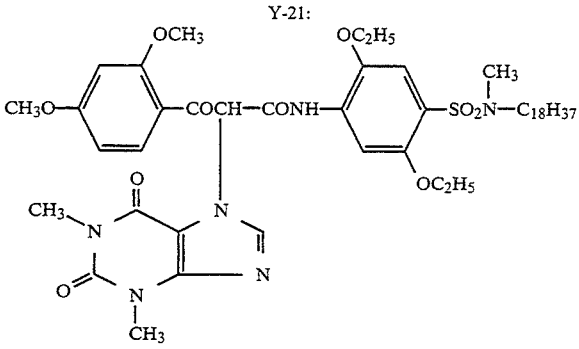

The colour couplers may be 4-equivalent couplers, but they may also be 2-equivalent couplers. The latter are derived from 4-equivalent couplers by containing a substituent at the coupling position which is eliminated on coupling. 2-equivalent couplers are considered to be those which are colourless, as well as those which have an intense intrinsic colour which on colour coupling disappears or is replaced by the colour of the image dye produced (mask couplers), and white couplers which, on reaction with colour developer oxidation products, give rise to substantially colourless products. 2-equivalent couplers are further considered to be those which contain an eliminable residue at the coupling position, which residue is liberated on reaction with colour developer oxidation products and so either directly or after one or more further groups are eliminated from the initially eliminated residue (for example, DE-A-27 03 145, DE-A-28 55 697, DE-A-31 05 026, DE-A-33 19 428), a specific desired photographic effect is produced, for example as a development inhibitor or accelerator. Examples of such 2-equivalent couplers are the known DIR couplers as well as DAR or FAR couplers.

DIR couplers, which release azole type development inhibitors, for example triazoles and benzotriazoles, are described in DE-A-24 14 006, 26 10 546, 26 59 417, 27 54 281, 28 42 063, 36 26 219, 36 30 564, 36 36 824, 36 44 416. Further advantages for colour reproduction, i.e. colour separation and colour purity, and for the reproduction of detail, i.e. sharpness and graininess, are to be achieved with such DIR couplers, which, for example, do not release the development inhibitor immediately as a consequence of coupling with an oxidised colour developer, but rather only after a further subsequent reaction, which is, for example, achieved with a time control group. Examples of this are described in DE-A-28 55 697, 32 99 671, 38 18 231, 35 18 797, in EP-A-0 157 146 and 0 204 175, in U.S. Pat. Nos. 4,146,396 and 4,438,393 and in GB-A-2 072 363.

DIR couplers which release a development inhibitor which is decomposed in the developer bath to substantially photographically inactive products are, for example, described in DE-A-32 09 486 and EP-A-0 167 168 and 0 219 713. By this means, problem-free development and processing consistency is achieved.

When DIR couplers are used, particularly those which eliminate a readily diffusible development inhibitor, improvements in colour reproduction, for example a more differentiated colour reproduction, may be achieved by suitable measures during optical sensitisation, as is described, for example, in EP-A-0 115 304, 0 167 173, GB-A-2 165 058, DE-A-37 00 419 and U,S, Pat. No. 4,707,436.

The DIR couplers may, in a multi-layer photographic material, be added to the most various layers, for example also to light-insensitive layers or interlayers. Preferably, however, they are added to the light-sensitive silver halide emulsion layers, wherein the characteristic properties of the silver halide emulsion, for example its iodide content, the structure of the silver halide grains or its grain size distribution influence the photographic properties achieved. The influence of the released inhibitors may, for example, be restricted by the incorporation of an inhibitor catching layer according to DE-A-24 31 223. For reasons of reactivity or stability, it may be advantageous to use a DIR coupler which on coupling forms a colour in the layer in which it is accommodated, which is different from the colour to be produced in this layer.

In order to increase sensitivity, contrast and maximum density, principally DAR or FAR couplers may be used which eliminate a development accelerator or fogging agent. Compounds of this type are described, for example, in DE-A-25 34 466, 32 09 110, 233 33 355, 34 10 616, 34 29 545, 34 41 823, in EP-A-0 089 834, 0 110 511, 0 118 087, 0 147 765 and in U.S. Pat. Nos. 4,618,572 and 4,656,123.

Reference is made to EP-A-193 389 as an example of the use of BAR couplers (bleach accelerator releasing coupler).

It may be advantageous to modify the effect of a photographically active group eliminated from a coupler by causing an intermolecular reaction of this group after its release with another group according to DE-A-35 06 805.

Since with the DIR, DAR or FAR couplers it is mainly the activity of the residue released on coupling that is desired and the colour-forming properties of these couplers are of lesser importance, those DIR, DAR or FAR couplers which give rise to substantially colourless products on coupling are also suitable (DE-A-15 47 640).

The eliminable residue may also be a ballast residue such that, on reaction with colour developer oxidation products, coupling products are obtained which are diffusible or have at least weak or restricted mobility (U.S. Pat. No. 4,420,556). The material may, in addition to couplers, contain various compounds which, for example, may liberate a development inhibitor, a development accelerator, a bleach accelerator, a developer, a silver halide solvent, a fogging agent or an anti-fogging agent, for example so-called DIR hydroquinones and other compounds as, for example, described in U.S. Pat. Nos. 4,636,546, 4,345,024, 4,684,604 and in DE-A-31 45 640, 25 15 213, 24 47 079 and in EP-A-198 438. These compounds fulfil the same function as the DIR, DAR or FAR couplers, except that they produce no coupling products.

High-molecular weight colour couplers are, for example, described in DE-C-1 297 417, DE-A-24 07 569, DE-A-31 48 125, DE-A-32 17200, DE-A-33 20 079, DE-A-33 24 932, DE-A-33 31 743, DE-A-33 40 376, EP-A-27 284, U.S. Pat. No. 4 080 211. The high-molecular weight colour couplers are generally produced by polymerisation of ethylenically unsaturated monomeric colour couplers. They may, however, also be obtained by polyaddition or polycondensation.

The incorporation of couplers or other compounds into the silver halide emulsion layers may proceed by initially producing a solution, dispersion or emulsion of the compound concerned and then adding it to the pouring solution for the layer concerned. Selection of the appropriate solvent or dispersant depends on the particular solubility of the compound.

Methods for the introduction of compounds which are essentially insoluble in water by a grinding process are described, for example, in DE-A-26 09 741 and DE-A-26 09 742.

Hydrophobic compounds may also be introduced into the pouring solution by using high-boiling solvents, so-called oil formers. Corresponding methods are described, for example, in U.S. Pat. Nos. 2,322,027, 2,801,170, 2,801,171 and EP-A-0 043 037.

Instead of high-boiling solvents, oligomers or polymers, so-called polymeric oil formers, may be used.

The compounds may also be introduced into the pouring solution in the form of filled latices. Reference is, for example, made to DE-A-25 41 230, DE-A-25 41 274, DE-A-28 35 856, EP-A-0 014 921, EP-A-0 069 671, EP-A-0 130 115, U.S. Pat. No. 4,291,113.

The non-diffusible inclusion of anionic water-soluble compounds (for example of dyes) may also proceed with the assistance of cationic polymers, so-called mordanting polymers.

Suitable oil formers are, for example, phthalic acid alkyl esters, phosphonic acid esters, phosphoric acid esters, citric acid esters, benzoic acid esters, amides, fatty acid esters, trimesic acid esters, alcohols, phenols, aniline derivatives and hydrocarbons.

Examples of suitable oil formers are dibutyl phthalate, dicyclohexyl phthalate, di-2-ethylhexyl phthalate, decyl phthalate, triphenyl phosphate, tricresyl phosphate, 2-ethylhexyldiphenyl phosphate, tricyclohexyl phosphate, tri-2-ethylhexyl phosphate, tridecyl phosphate, tributoxyethyl phosphate, trichloropropyl phosphate, di-2-ethylhexylphenyl phosphate, 2-ethylhexyl benzoate, dodecyl benzoate, 2-ethylhexyl-p-hydroxybenzoate, diethyldodecanamide, N-tetradecylpyrrolidone, isostearyl alcohol, 2,4-di-t-amylphenol, dioctyl acelate, glycerol tributyrate, iso-stearyl lactate, trioctyl citrate, N,N-dibutyl-2-butoxy-5-t-octyl aniline, paraffin, dodecyl benzene and diisopropylnaphthaline.

According to the invention, at least one silver halide emulsion layer contains a coupler distributed in a polymeric oil former in combination with a compound of the formula (I).

Each of the differently sensitised light-sensitive layers may consist of a single layer or may also comprise two or more partial layers of silver halide emulsion (DE-C-1 121 470). Here, red-sensitive silver halide emulsion layers are often located more closely to the film support than green-sensitive silver halide emulsion layers and these in turn are closer than blue-sensitive layers, wherein there is generally a non light-sensitive yellow filter layer between the green-sensitive layers and the blue-sensitive layers.

In cases of suitably low intrinsic sensitivity of the green or red-sensitive layers, different layer arrangements may be selected, dispensing with the yellow filter layer, in which, for example, the blue-sensitive, then the red-sensitive and finally the green-sensitive layers follow each other on the support.

The non light-sensitive interlayers generally located between layers of different spectral sensitivity may contain agents which prevent an undesirable diffusion of developer oxidation products from one light-sensitive layer into another light-sensitive layer with a different spectral sensitisation.

Suitable agents, which are also known as scavengers or EOP catchers, are described in *Research Disclosure* 17 643 (December 1978), section VII, 17 842 (February 1979) and 18 716 (November 1979), page 650 and in EP-A-0 069 070, 0 098 072, 0 124 877, 0 125 522.

If there are several partial layers of the same spectral sensitisation, then they may differ in composition, particularly in terms of the type and quantity of silver halide granules. In general, the partial layer with the greater sensitivity will be located further from the support than the partial layer with lower sensitivity. Partial layers of the same spectral sensitisation may be adjacent to each other or may be separated by other layers, for example layers of different spectral sensitisation. Thus, for example, all highly sensitive and all low sensitivity layers may be grouped together each in a package of layers (DE-A-19 58 709, DE-A-25 30 645, DE-A-26 22 922).

The photographic material may also contain UV light absorbing compounds, optical whiteners, spacers, filter dyes, formaline catchers, light-protection agents, antioxidants, $D_{min}$ dyes, additives to improve stabilisation of dyes, couplers, whiteners and to reduce colour fogging, plasticisers (latices), biocides and others.

UV light absorbing compounds are intended on the one hand to protect the colour dyes from bleaching by high-UV daylight and on the other hand to absorb the UV light in daylight on exposure and so improve the colour reproduction of a film. Customarily, compounds of different structure are used for the two tasks. Examples are aryl-substituted benzotriazole compounds (U.S. Pat. No. 3,533,794), 4-thiazolidone compounds (U.S. Pat. Nos. 3,314,794 and 3,352,681), benzophenone compounds (JP-A-2784/71), cinnamic acid ester compounds (U.S. Pat. Nos. 3,705,805 and 3 707 375), butadiene compounds (U.S. Pat. No. 4,045,229) or benzoxazole compounds (U.S. Pat. No. 3,700,455).

Ultra-violet absorbing couplers (such as cyan couplers of the α-naphthol type) and ultra-violet absorbing polymers may also be used. These ultra-violet absorbants may be fixed into a special layer by mordanting.

Filter dyes suitable for visible light include oxonol dyes, hemioxonol dyes, styryl dyes, merocyanine dyes, cyanine dyes and azo dyes. Of these dyes, oxonol dyes, hemioxonol dyes and merocyanine dyes are particularly advantageously used.

Suitable optical whiteners are, for example, described in *Research Disclosure* 17 643 (December 1978), section V, in U.S. Pat. Nos. 2,632,701, 3,269,840 and in GB-A-852 075 and 1 319 763.

Certain binder layers, in particular the layer furthest away from the support, but also occasionally interlayers, particularly if they constitute the layer furthest away from the support during manufacture, may contain photographically inert particles of an inorganic or organic nature, for example as flatting agents or spacers (DE-A-33 31 542, DE-A-34 24 893, *Research Disclosure* 17 643 (December 1978), section XVI).

The average particle diameter of the spacers is in particular in the range from 0.2 to 10 μm. The spacers are insoluble in water and may be soluble or insoluble in alkali, wherein alkali-soluble spacers are generally removed from the photographic material in the alkaline developing bath. Examples of suitable polymers are polymethyl methacrylate, copolymers of acrylic acid and methyl methacrylate together with hydroxypropylmethylcellulosehexahydrophthalate.

Additives to improve the stability of dyes, couplers and whiteners and to reduce colour fogging (*Research Disclosure* 17 643 (December 1978), section VII) may belong to the following classes of chemical substances: hydroquinones, 6-hydroxychromanes, 5-hydroxycoumaranes, spirochromanes, spiroindanes, p-alkoxyphenols, sterically hindered phenols, gallic acid derivatives, methylene dioxybenzenes, aminophenols, sterically hindered amines, derivatives with esterified or etherified phenolic hydroxyl groups, metal complexes.

Compounds having both a sterically hindered amine partial structure and a sterically hindered phenol partial structure in one molecule (U.S. Pat. No. 4,268,593) are particularly effective in preventing the degradation of yellow colour images as a consequence of the development of heat, moisture and light. In order to prevent the degradation of magenta colour images, in particular their degradation due to the effects of light, spiroindanes (JP-A-159 644/81) and chromanes which are mono-or disubstituted by alkoxy groups (JP-A-89 835/80) are particularly effective.

The layers of the photographic material may be hardened with customary hardeners. Suitable hardeners are, for example, formaldehyde, glutaraldehyde and similar aldehyde compounds, diacetyl, cyclopentadione and similar ketone compounds, bis(2-chloroethylurea), 2-hydroxy-4,6-dichloro-1,3,5-triazine and other compounds containing reactive halogen (U.S. Pat. Nos. 3,288,775, 2,732,303, GB-A-974 723 and GB-A-1 167 207), divinylsulphone compounds, 5-acetyl-1,3-diacryloylhexahydro-1,3,5-triazine and other compounds containing a reactive olefin bond (U.S. Pat. Nos. 3,635,718, 3,232,763 and GB-A-994 869); N-hydroxymethyl-phthalimide and other N-methylol compounds (U.S. Pat. Nos. 2,732,316 and 2,586,168); isocyanates (U.S. Pat. No. 3,103,437); aziridine compounds (U.S. Pat. Nos. 3,017,280 and 2,983,611); acid derivatives (U.S. Pat. Nos. 2,725,294 and 2,725,295); compounds of the carbodiimide type (U.S. Pat. No. 3,100,704); carbamoylpyridinium salts (DE-A-22 25 230 and DE-A-24 39 551); carbamoyloxypyridinium compounds (DE-A-24 08 814); compounds with a phosphorus-halogen bond (JP-A-113 929/83); N-carbonyloximide compounds (JP-A-43353/81); N-sulphonyloximido compounds (U.S. Pat. No. 4,111,926), dihydroquinoline compounds (U.S. Pat. No. 4,013,468), 2-sulphonyloxypyridinium salts (JP-A-110 762/81), formamidinium salts (EP-A-0 162 308), compounds with two or more N-acycloximino groups (U.S. Pat. No. 4,052,373), epoxy compounds (U.S. Pat. No. 3,091,537), compounds of the isoxazole type (U.S. Pat. Nos. 3,321,313 and 3,543,292); halogen carboxyaldehydes, such as mucochloric acid; dioxane derivatives, such as dihydroxydioxane and dichlorodioxane; and inorganic hardeners such as chrome alum and zirconium sulphate.

Hardening may be effected in a known manner by adding the hardener to the pouring solution for the layer to be hardened, or by overcoating the layer to be hardened with a layer containing a diffusible hardener.

There are included in the classes listed slow acting and fast acting hardeners as well as so-called instant hardeners, which are particularly advantageous. Instant hardeners are understood to be compounds which crosslink suitable binders in such a way that immediately after pouring, at the latest after 24 hours, preferably at the latest after 8 hours, hardening is concluded to such an extent that there is no further alteration in the sensitometry and swelling of the layered structure determined by the crosslinking reaction. Swelling is understood as the difference between the wet layer thickness and the dry, layer thickness during aqueous processing of the film (*Photogr. Sci. Eng.* 8 (1964), 275; *Photogr. Sci. Eng.* (1972), 449).

These hardeners which react very rapidly with gelatine are, for example, carbamoylpyridinium salts, which enable the free carboxyl groups of the gelatine to react, so that the latter react with free amino groups of the gelatine forming peptide bonds and crosslinking the gelatine.

Suitable examples of instant hardeners are, for example, compounds of the general formulae

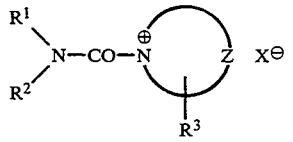

in which $R^1$ means alkyl, aryl or aralkyl, $R^2$ has the same meaning as $R^1$ or means alkene, arylene, aralkene or alkaralkene, wherein the second bond is made with a group of the formula

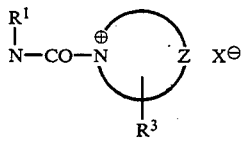

or $R^1$ and $R^2$ together mean the atoms required to complete an optionally substituted heterocyclic ring, for example a piperidine, piperazine or morpholine ring, wherein the ring may, for example, be substituted by C I-$C_3$ alkyl or halogen, $R^3$ stands for hydrogen, alkyl, aryl, alkoxy, —$NR^4$—$COR^5$, —$(CH_2)_m$—$NR^8R^9$—$(CH_2)_n$—$CONR^{13}R^{14}$ or $$-(CH_2)_p-\underset{\underset{R^{15}}{|}}{CH}-Y-R^{16}$$

or a bridging member or a direct bond to a polymer chain, wherein $R^4$, $R^6$, $R^7$, $R^9$, $R^{14}$, $R^{15}$, $R^{17}$, $R^{18}$ and $R^{19}$ mean hydrogen or $C_1$–$C_4$ alkyl, $R^5$ means hydrogen, $C_1$–$C_4$ alkyl or $NR^6R^7$, $R^8$ means —$COR^{10}$ $R^{10}$ means $NR^{11}R^{12}$ $R^{11}$ means $C_1$–$C_4$ alkyl or aryl, in particular phenyl, $R^{12}$ means hydrogen, $C_1$–$C_4$ alkyl or aryl, in particular phenyl, $R^{13}$ means hydrogen, $C_1$–$C_4$ alkyl or aryl, in particular phenyl, $R^{16}$ means hydrogen, $C_1$–$C_4$ alkyl or aryl, —$COR^{18}$ or —$CONHR^{19}$, m means a number from 1 to 3 n means a number from 0 to 3 p means a number from 2 to 3

Y means 0 or $NR^{17}$ or $R^{13}$ and $R^{14}$ together represent the atoms required to complete an optionally substituted heterocyclic ring, for example a piperidine, piperazine or morpholine ring, wherein the ring may, for example, be substituted by $C_1$–$C_3$ alkyl or halogen, Z means the C atoms required to complete a 5 or 6 member aromatic heterocyclic ring, optionally with an anellated benzene ring, and $X^{\ominus}$ means an anion which is not present if an anionic group is already linked with the remainder of the molecule;

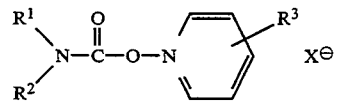

(b)

in which $R^1$, $R^2$, $R^3$ and $X^e$ have the meanings stated for formula (a).

There are diffusible hardeners which have the same hardening effect on all the layers in a layered structure. There are, however, also non-diffusing low molecular weight and high molecular weight hardeners the action of which is restricted within a layer. Using these, individual layers, for example the protective layer, may be particularly highly crosslinked. This is important if the silver halide layer is sparingly hardened in order to increase the silver covering power and the mechanical properties of the protective layer must be improved (EP-A-0 114 699).

Colour photographic negative materials are customarily processed by developing, bleaching, fixing and rinsing or by developing, bleaching, fixing and stabilising without subsequent rinsing, wherein bleaching and fixing may be combined into a single processing stage.

Colour developer compounds which may be used are all developer compounds having the ability to react, in the form of their oxidation product, with colour couplers to azomethine or indophenol dyes. Suitable colour developer compounds are aromatic compounds containing at least one primary amino group of the p-phenylenediamine type, for example N,N-dialkyl-p-phenylenediamines such as N,N-diethyl-p-phenylenediamine, 1-(N-ethyl-N-methanesulphone-amidoethyl)-3-methyl-p-phenylenediamine, 1-(N-ethyl-N-hydroxyethyl)-3-methyl-p-phenylenediamine 1-(N-ethyl-N-hydroxypropyl)-3-methyl-p-phenylenediamine and 1-(N-ethyl-N-methoxyethyl)-3-methyl-p-phenylenediamine. Further usable colour developers are described for example in *J. Amer Chem. Soc.* 73, 3106 (1951) and *G. Haist Modern Photographic Processing,* 1979, John Wiley & Sons, New York, pages 545 et seq.

An acid stop bath or rinsing may follow after colour development.

Customarily, the material is bleached and fixed immediately after colour development. Bleaches which may be used are, for example, Fe(III) salts and Fe(III) complex salts such as ferricyanides, dichromates, water soluble cobalt complexes. Iron(III) complexes of aminopolycarboxylic acids are particularly preferred, in particular for example complexes of ethylenediaminetetraacetic acid, propylene-diaminetetraacetic acid, diethylenetriaminepentaacetic acid, nitrilotriacetic acid, iminodiacetic acid, N-hydroxyethylethylenediaminetriacetic acid, alkyliminodicarboxylic acids and of corresponding phosphonic acids. Also suitable as bleaches are persulphates and peroxides, for example hydrogen peroxide.

Rinsing usually follows the bleaching-fixing bath or fixing bath, which is performed as countercurrent rinsing or consists of several tanks with their own water supply.

Favourable results may be obtained by using a subsequent finishing bath which contains no or only a little formaldehyde.

Rinsing may, however, be completely replaced with a stabilising bath, which is customarily performed countercurrently. If formaldehyde is added, this stabilising bath also performs the function of a finishing bath.

With colour reversal materials, there is an initial development with a black and white developer, the oxidation product of which is not capable of reacting with the colour couplers. There then follows a diffuse second exposure and then development with a colour developer, bleaching and fixing.

EXAMPLE 1

Colour photographic recording materials were produced as follows a) Production of emulsified colour couplers 8 mmol of colour coupler are dissolved in the same amount by weight of dibutyl phthalate (DBP) and three times the amount by weight of ethyl acetate in the presence of 0.15 g of sulphosuccinic acid dioctyl ester at a temperature of 50° to 70° C. 25 wt. %, related to the quantity of coupler, of the light-stabilising compound to be tested is also optionally added to the solution. The solution is then stirred and dispersed into 150 g of 7.5 wt. % aqueous gelatine solution which is at a temperature of approx. 40° C. The ethyl acetate is distilled off.

Dibutyl phthalate is optionally replaced by the same amount of polymeric oil former.

b) Production of the colour photographic recording materials to be tested.

The emulsified mixture produced in a) above is mixed with a silver halide emulsion containing 8.2 g of silver in the form of silver halide, 9.2 g of gelatine and 0.04 g of sodium dodecylbenzenesulphonate. The total volume is adjusted to 350 ml with water. The pouring solution so prepared is poured onto a cellulose triacetate film support.

c) Processing and evaluation

After drying, the material is exposed behind a step wedge and conventionally processed, wherein the colour developer substance used was 2-amino-5-(N-ethyl-N-methanesulphone-amidoethylamino)-toluene.

The processed samples are then covered with a UV protective film, irradiated in a Xenotest device to determine light-fastness (40% relative humidity; 25° C.; $9.6 \cdot 10^6$ lx·h). The UV protective film was produced as follows. A layer prepared from 1.5 g of gelatine, 0.65 g of compound A (UV absorber) of the following formula

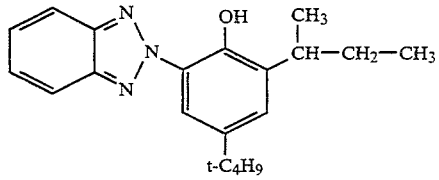

0.07 g of dioctylhydroquinone and 0.36 g of tricresyl phosphate is applied to a transparent cellulose triacetate film coated with a coupling agent. The amounts are per 1 $m^2$.

TABLE 1

| No | Coupler | Compound I | Oil former | Decrease in density in % at D = 0.5 | D = 1.0 | $D_{max}$ |
|---|---|---|---|---|---|---|
| 1 Comparison | Y-9 | — | DBP | 31 | 37 | 50 |
| 2 Invention | Y-9 | I-9 | DBP | 15 | 11 | 18 |
| 3 Invention | Y-9 | I-9 | P 8 | 9 | 6 | 9 |
| 4 Invention | Y-9 | I-5 | P 8 | 12 | 8 | 13 |
| 5 Invention | Y-9 | I-9 | P 1 | 12 | 9 | 15 |
| 6 Comparison | Y-9 | V-1 | DBP | 17 | 12 | 20 |
| 7 Comparison | Y-9 | I-19 | DBP | 19 | 14 | 20 |
| 8 Invention | Y-9 | I-19 | P 8 | 13 | 9 | 15 |
| 9 Comparison | Y-9 | I-20 | DBP | 22 | 15 | 21 |
| 10 Invention | Y-9 | I-20 | P 8 | 15 | 10 | 10 |

TABLE 2

| No. | Coupler | Compound I (20% incorporated) | Oil former | Decrease in density in % at D = 0.5 | D = 1.0 | $D_{max}$ |
|---|---|---|---|---|---|---|
| 1 Comparison | Y-12 | — | DBP | 35 | 32 | 40 |
| 2 Invention | Y-12 | I-9 | DBP | 19 | 14 | 20 |
| 3 Invention | Y-12 | I-9 | P 8 | 8 | 8 | 11 |
| 4 Invention | Y-12 | I-9 | P 1 | 10 | 12 | 15 |

Compound V-1 (comparison stabiliser) has the formula

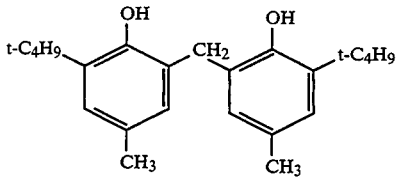

The tests show that, while the compounds of formula (I) do exhibit a stabilising effect when dibutyl phthalate is used as the oil former compared with tests in which no stabiliser is used, this effect is not perceptibly better than the effect of comparison substance V-1. On the other hand, when the compounds of formula (I) and the polymeric oil former are used together, a considerable improvement in the stabilising effect is found.

EXAMPLE 2

A colour photographic recording material was prepared by applying the following layers in the sequence given to a paper which was coated with polyethylene on both sides. The quantities are based on 1 $m^2$. The quantity of silver applied is given in terms of the corresponding quantity of $AgNO_3$.

Layer arrangement 1

1 st Layer (substrate layer)
0.2 g of gelatine
2nd Layer (blue-sensitive layer)
blue-sensitive silver halide emulsion (99.5 mol-% of chloride, 0.5 mol-% or bromide, average grain diameter 0.78 μm) from 0.50 g of $AgNO_3$ containing
1.38 g of gelatine
0.60 g of yellow coupler Y-1
0.47 g of tricresyl phosphate (TCP) and
0.18 g of stabilizer according to Table 3
3rd Layer (interlayer)
1.18 g of gelatine
0.08 g of 2,5-dioctylhydroquinone and
0.08 g of dibutylphthalate (DBP)
4th Layer (green-sensitive layer)
green sensitized silver halide emulsion (99.5 mol-% of chloride, 0.5 mol-% of bromide, average grain diameter 0.37 μm) from 0.40 g of $AgNO_3$containing
1.02 g of gelatine
0.37 g of magenta coupler M-1 and
0.40 g of DBP
5th Layer (interlayer)
1.20 g of gelatine
0.66 g of UV absorbent corresponding to the formula

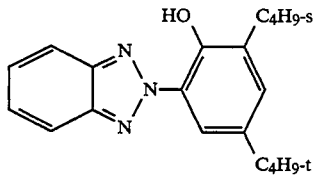

0.052 g of 2,5-dioctylhydroquinone and
0.36 g of TCP
6th Layer (red-sensitive layer)
red sensitized silver halide emulsion (99.5 mol-% of chloride, 0.5 mol-% of bromide, average grain diameter of 0.35 μm) from 0.28 g of $AgNO_3$ containing
0.84 g of gelatine
0.39 g of cyan coupler C-1 and
0.39 g of TCP
7th Layer (UV protective layer)
0.65 g of gelatine
0.21 g of UV absorbent as in 5th layer and
0.11 g of TCP
8th Layer (protective layer)
0.65 g of gelatine and
0.39 g of hardener corresponding to the following formula:

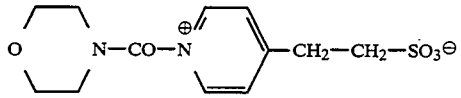

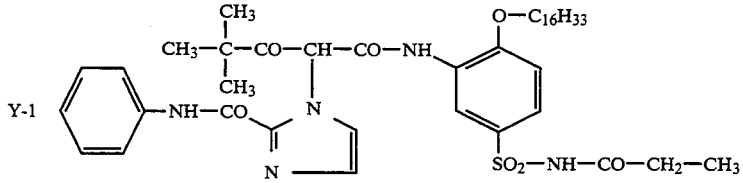

-continued

C-1

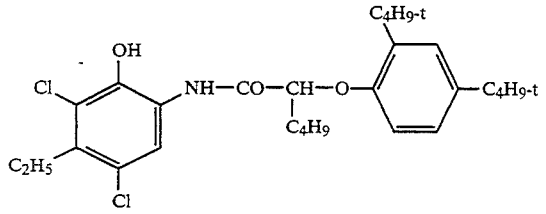

M-1

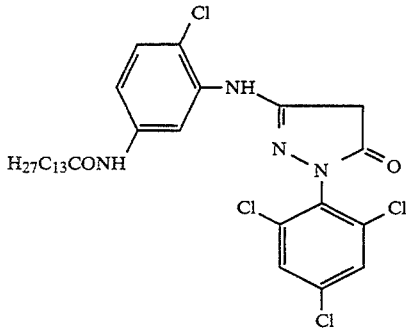

| | | |
|---|---|---|
| a) | Colour developer-45 s-35° C. | |
| | Triethanolamine | 9.0 g/l |
| | N,N-Diethythydroxylamine | 4.0 g/l |
| | Diethylene glycol | 0.05 g/l |
| | 3-Methyl-4-amino-N-ethyl-N-methane-sulphonylamidoethyl-aniline-sulphate | 5.0 g/l |
| | Potassium sulphite | 0.2 g/l |
| | Triethylene glycol | 0.05 g/l |
| | Potassium carbonate | 2 g/l |
| | Potassium hydroxide | 0.4 g/l |
| | Ethylene diaminotetracetic acid disodium salt | 2.2 g/l |
| | Potassium chloride | 5 g/l |
| | 1,2-Dihydroxybenzene-3,4,6-trisulphonic acid trisodium salt | 0.3 g/l |
| | made up with water to 100 ml; | pH 10.0 |
| b) | Bleach Fixing bath-45 s-35° C. | |
| | Ammonium thiosulphate | 75 g/l |
| | Sodium hydrogen sulphite | 13.5 g/l |
| | Ammonium acetate | 2.0 g/l |
| | Ethylene diaminotetracetic acid (iron-ammonium salt) | 57 g/l |
| | Ammonia, 25% by weight | 9.5 g/l |
| | Acetic acid | 9.0 g/l |
| | made up with water to 1000 ml; | pH 5.5 |

c) Washing—2 min—35° C.

d) Drying

The processed samples were subjected to a Xenon lamp according to ISO 10 977 (½ g fog correction) for 14.4 million Lux hours at various yellow density. The results are given in Table 3.

TABLE 3

| Sample | Stabilizer | Changes in colour density in % at Density 0.6 | Density 1.0 | Density 1.4 |
|---|---|---|---|---|
| 1 | — | −40 | −31 | −27 |
| 2 | I-9 | −15 | −9 | −10 |
| 3 | V-1 | −23 | −19 | −20 |
| 4 | V-2 | −20 | −10 | −11 |
| 5 | V-3 | −16 | −12 | −11 |
| 6 | V-4 | −21 | −14 | −13 |
| 7 | V-5 | −35 | −26 | −22 |
| 8 | I-12 | −16 | −10 | −10 |

Sample 2 and 8 are according to the invention.

The Comparison stabilizers have the following formulae:

V-2

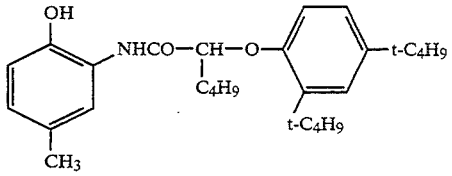

V-3

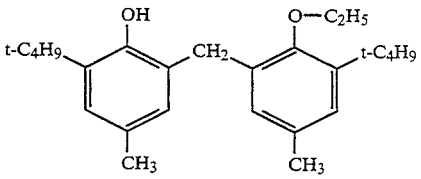

-continued

V-4

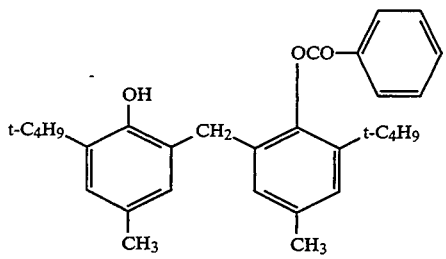

V-5

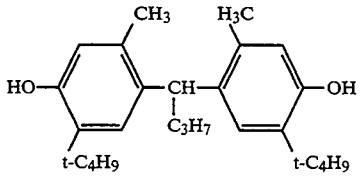

EXAMPLE 3

The following two layers were applied to a paper which was coated on both sides with polyethylene. The quantities are based on 1 $m^2$.

1st Layer blue-sensitive silver halide emulsion according to Example 2 from 0.6 g $AgNO_3$ containing 2.0 g of gelatine 0.8 g of yellow coupler Y-1

0.6 g of TCP and 0.24 g of stabiliser according to Table 4

2nd Layer 2.0 g of gelatine and 0.4 g of hardener according to Example 2.

Processing was as in Example 2.

The processed material was stored for 21 days at 80° C. and 50% relative moisture. Decomposition of the yellow dyestuff to coloured products occurred. The densities behind a red and a green filter and after storage were determined at densities of 1.0 and 2.0 behind a blue filter with a densitometer. The increase in density in percent is given in Table 4.

TABLE 4

| | | Additional density in % at | | | |
|---|---|---|---|---|---|
| | | Density 1.0 | | Density 2.0 | |
| Sample | Stabilizer | green filter | red filter | green filter | red filter |
| 9 | — | +31 | +24 | +37 | +19 |
| 10 | I-9 | +5 | +10 | +20 | +10 |
| 11 | V-1 | +25 | +12 | +46 | +14 |
| 12 | V-2 | +28 | +13 | +42 | +15 |
| 13 | V-3 | +28 | +17 | +45 | +13 |
| 14 | V-4 | +26 | +17 | +42 | +15 |
| 15 | V-6 | +25 | +16 | +33 | +15 |
| 16 | I-12 | +7 | +12 | +22 | +12 |

Comparison stabiliser V-6 had the following formula:

V-6

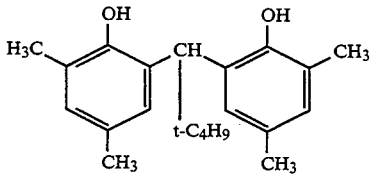

Samples 10 and 16 are according to the invention.

EXAMPLE 4

Example 3 was repeated with a material which contained yellow coupler Y-2 instead of yellow coupler Y-1 in the same amount.

After processing the material was stored for 21 days at 80° C. and 50% relative moisture. The results are given in Table 5.

TABLE 5

| | | Additional density in % at | | | |
|---|---|---|---|---|---|
| | | Density 1.0 | | Density 2.0 | |
| Sample | Stabiliser | green filter | red filter | green filter | red filter |
| 17 | — | +29 | +24 | +60 | +30 |
| 18 | I-9 | +2 | +15 | +9 | +16 |
| 19 | V-1 | +18 | +21 | +33 | +18 |
| 20 | V-2 | +7 | +20 | +60 | +26 |
| 21 | V-6 | +28 | +21 | +54 | +21 |
| 22 | V-7 | +7 | +22 | +38 | +24 |
| 23 | V-5 | +20 | +19 | +30 | +22 |
| 24 | I-12 | +5 | +16 | +12 | +18 |

Y-2:

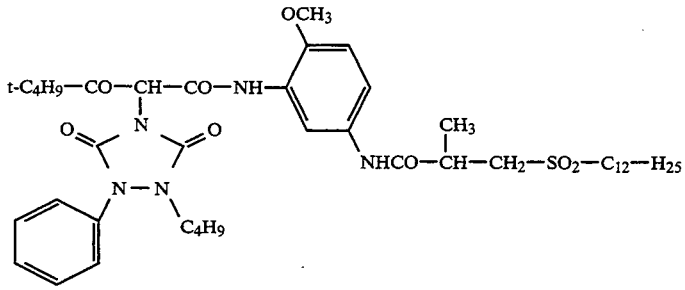

Comparison stabiliser V-7 had the following formula

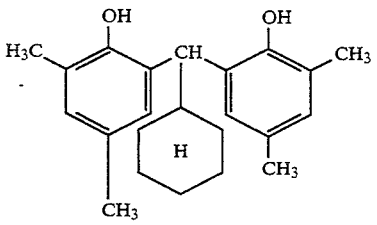

Samples 18 and 24 are according to the invention.

As shown in Example 3 and 4 the samples according to the invention (10, 16, 18 and 24) have a smaller increase in unwanted secondary density after storage at high temperature and high moisture than the comparison samples. Thus the natural hues are maintained better under storage conditions.

We claim:

1. Color photographic material comprising at least one silver halide emulsion layer which contains a color coupler distributed in a polymeric oil former and at least one bisphenol compound of the formula (II)

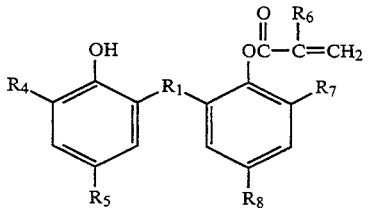

(II)

in which $R_1$ is alkylene, alkylidene or sulphonyl, $R_4$, $R_5$, $R_7$, $R_8$ are the same or different and are alkyl or aryl and $R_6$ is hydrogen or aryl, wherein the polymeric oil former corresponds to formula (III)

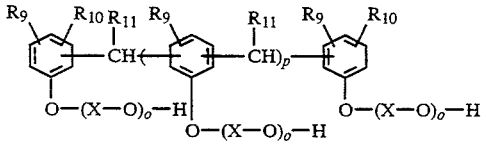

(III)

in which $R_9$ means hydrogen or alkyl $R_{10}$ means alkyl $R_{11}$ means hydrogen alkyl X means

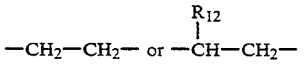

$R_{12}$ means alkyl o means an integer from 1 to 5 p means an integer from 0 to 5.

2. The color photographic material according to claim 1, wherein the bisphenol compound is used in an amount of 0.1 to 2 g/g of color coupler and the polymeric oil former is used in an amount of 0.05 to 10 g/g of color coupler.

3. The color photographic material according to claim 2, wherein the bisphenol compound is used in an amount of 0.1 to 1 g/g of color coupler and the polymeric oil former is used in an amount of 0.1 to 4 g/g of color coupler.

4. The color photographic material according to claim 1, characterised in that the average molecular weight (weight average) of the polymeric oil former is no greater than 200 000.

5. The color photographic material according to claim 4, wherein the average molecular weight of the polymeric oil former is 400 to 100,000.

6. The color photographic material according to claim 1, wherein the color coupler distributed in the polymeric oil former is a yellow coupler.

7. The color photographic material according to claim 1, wherein $R_9$ is hydrogen, $R_{10}$ is a $C_1$–$C_{12}$-alkyl residue, $R_{11}$ is hydrogen, $R_{12}$ is methyl, o is an integer from 1 to 4, and p is an integer from 0 to 5.

8. The color photographic material according to claim 7, wherein $R_{10}$ is a $C_1$–$C_{12}$-alkyl residue which is in the para-position to the oxygen.

9. The color photographic material as claimed in claim 1, wherein o is an integer from 1 to 4.

10. A color photographic material comprising at least one silver halide emulsion layer which contains a color coupler distributed in a polymeric oil former and at least one bisphenol compound of the formula (I)

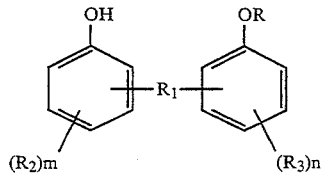

(I)

in which

R means alkyl, cycloalkyl, alkenyl, aryl, acyl, alkylsulphonyl or arylsulphonyl, $R_1$ is alkylene, alkylidene or sulphonyl, $R_2$ and $R_3$ are the same or different and mean alkyl, alkoxy, alkenyl, cycloalkyl, aryl or aryloxy or two residues $R_2$ or $R_3$ the remaining atoms of a benzene ring condensed with the phenyl residue and m and n are the same or different and mean an integer from 0 to 3, wherein alkyl, alkoxy, cycloalkyl, alkenyl, aryl, aryloxy and acyl residues, wherein the polymeric oil former corresponds to formula (III)

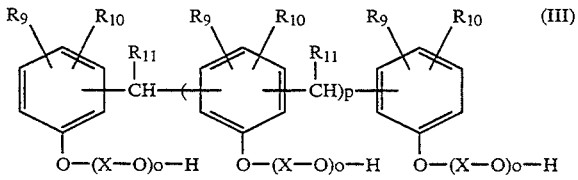

(III)

in which $R_9$ means hydrogen or alkyl $R_{10}$ means alkyl $R_{11}$ means hydrogen or alkyl X means

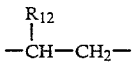

$R_{12}$ means alkyl o is an integer from 1 to 10 p is an integer from 0 to 20.

11. The color photographic material as claimed in claim 10, wherein o is an integer from 1 to 5 and p is an integer from 0 to 10.

12. The color photographic material as claimed in claim 11, wherein o is an integer from 1 to 4.

13. The color photographic material according to claim 10, wherein $R_2$, $R_{2'}$, $R_3$ and $R_4$ are selected from the groups consisting of a) $R_2$ and $R_{2'}$ are $C_2H_5$, $R_3$ and $R_4$ are H;

b) $R_2$ and $R_{2'}$ are t-$C_4H_9$, and $R_3$ and $R_4$ are H;

c) $R_2$ and $R_{2'}$ are n-$C_4H_9$, and $R_3$ and $R_4$ are H;

d) $R_2$ and $R_{2'}$ are $CH_3$, and $R_3$ and $R_4$ are H;

e) $R_2$ and $R_{2'}$ are $C_9H_{19}$, and $R_3$ and R4 are H;

f) $R_2$ and $R_{2'}$ are $C_2H_5$, and $R_3$ is $CH_3$ and $R_4$ is H;

g) $R_2$ and $R_{2'}$ are $CH_3$, and $R_3$ is $CH_3$ and $R_4$ is H;

h) $R_2$ and $R_{2'}$ are $CH_3$, and $R_3$ is H and $R_4$ is $CH_3$;

i) $R_2$ and $R_{2'}$ are $CH_3$, and $R_3$ is H and $R_4$ is $C_6H_5$; and j) $R_2$ and $R_{2'}$ are t-$C_4H_9$, and $R_3$ is $CH_3$ and $R_4$ is H.

14. Color photographic material comprising at least one silver halide emulsion layer which contains a color coupler distributed in a polymeric oil former and at least one bisphenol compound of the formula

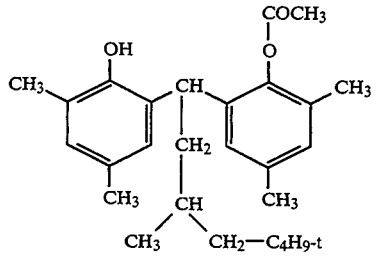

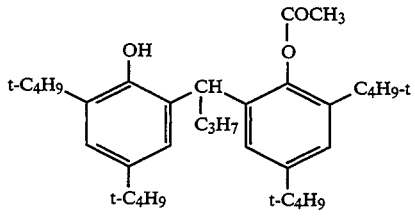

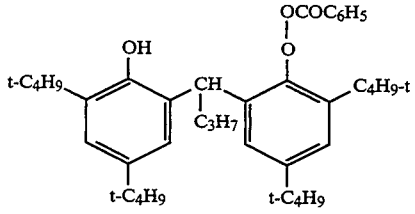

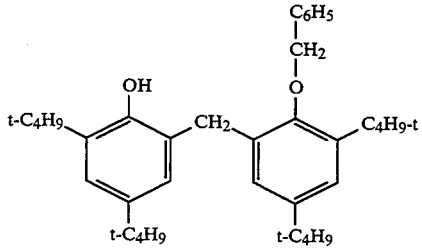

-continued

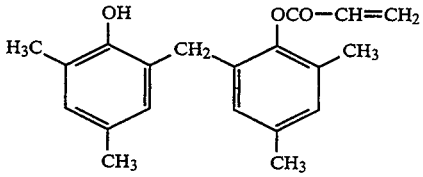

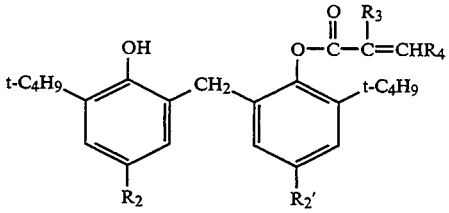

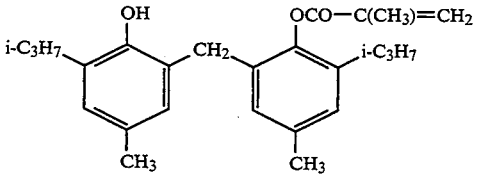

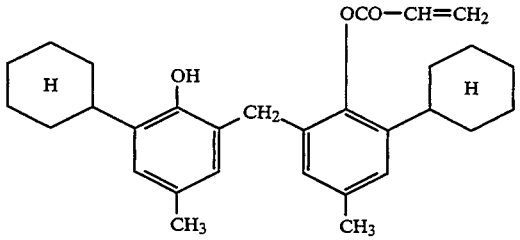

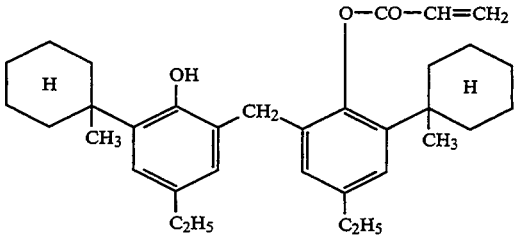

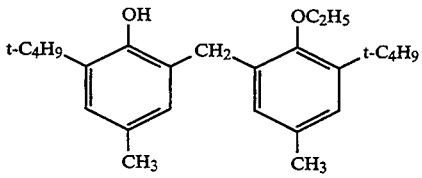

and

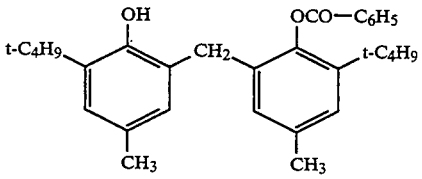

in which $R_3$ and $R_4$ are identical or different and are hydrogen or alkyl, wherein the polymeric oil former corresponds to formula (III)

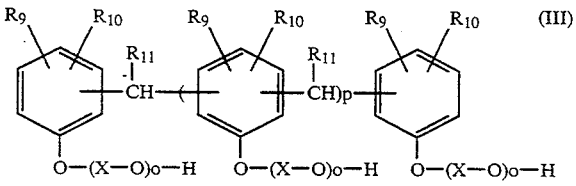
(III)
in which
$R_9$ means hydrogen or alkyl
$R_{10}$ means alkyl
$R_{11}$ means hydrogen or alkyl
X means $—CH_2—CH_2—$ or
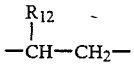
$R_{12}$ means alkyl
o means an integer from 1 to 5
p means an integer from 0 to 5.
* * * * *